US008157025B2

(12) United States Patent
Johnson

(10) Patent No.: US 8,157,025 B2
(45) Date of Patent: Apr. 17, 2012

(54) ADJUSTABLE ANGLE DRIVE CONNECTION FOR A DOWNHOLE DRILLING MOTOR

(76) Inventor: Orren S. Johnson, Edmonton (CA)

( * ) Notice: Subject to any disclaimer, the term of this patent is extended or adjusted under 35 U.S.C. 154(b) by 169 days.

(21) Appl. No.: 12/467,129

(22) Filed: May 15, 2009

(65) Prior Publication Data

US 2009/0288885 A1 Nov. 26, 2009

(30) Foreign Application Priority Data

May 26, 2008 (CA) ..... 2632634

(51) Int. Cl.
*E21B 7/08* (2006.01)

(52) U.S. Cl. ..... 175/74; 175/101

(58) Field of Classification Search ..... 175/74, 175/101; 464/18, 19, 155, 156
See application file for complete search history.

(56) References Cited

U.S. PATENT DOCUMENTS 5,467,832 A * 11/1995 Orban et al. ..... 175/45
5,474,334 A * 12/1995 Eppink ..... 285/184
5,542,482 A * 8/1996 Eddison ..... 175/61
7,186,182 B2 * 3/2007 Wenzel et al. ..... 464/19
7,243,739 B2 * 7/2007 Rankin, III ..... 175/73

* cited by examiner

*Primary Examiner* — David Bagnell
*Assistant Examiner* — Richard Alker
(74) *Attorney, Agent, or Firm* — Christensen O'Connor Johnson Kindness PLLC

(57) ABSTRACT

A drive connection for a downhole drilling motor includes a tubular outer housing with an inner mandrel. The outer housing has a motor end, a bit end and defines an interior bore. An angular offset is provided toward the bit end of the outer housing. The inner mandrel, positioned within the interior bore of the outer housing, includes a motor end section, a bit end section and an intermediate section connecting the motor end section and the bit end section. The intermediate section has an upper articulating engagement that is coupled to rotate with the motor end section and a lower articulating engagement that is coupled to rotate with the bit end section. The motor end section, intermediate section and bit end section rotate together, with the upper articulating engagement and the lower articulating engagement accommodating rotation that is offset due to the angular offset.

15 Claims, 5 Drawing Sheets

SECTION '8 – 8'

ADJUSTABLE ANGLE DRIVE CONNECTION FOR A DOWNHOLE DRILLING MOTOR

FIELD

A drive connection used for directional drilling that is positioned between a downhole drilling motor and a drill bit.

BACKGROUND

Bent housings are placed in a drilling motor assembly in order to cause the bore hole created by a drilling motor to deviate from a vertical orientation to a desired angular orientation. These bent housings can be either fixed or adjustable. It is desirable to position the bent housing as close as possible to the drill bit in order to decrease the radius of curvature of the bore hole and reduce stress on the drilling motor assembly during rotation.

SUMMARY

There is provided a drive connection for a downhole drilling motor which includes a tubular outer housing with an inner mandrel. The outer housing has a motor end, a bit end and defines an interior bore. An angular offset is provided toward the bit end of the outer housing. The inner mandrel, positioned within the interior bore of the outer housing, includes a motor end section, a bit end section and an intermediate section connecting the motor end section and the bit end section. The intermediate section has an upper articulating engagement that is coupled to rotate with the motor end section and a lower articulating engagement that is coupled to rotate with the bit end section. The motor end section, intermediate section and bit end section rotate together, with the upper articulating engagement and the lower articulating engagement accommodating rotation that is offset due to the angular offset of the drive shaft.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
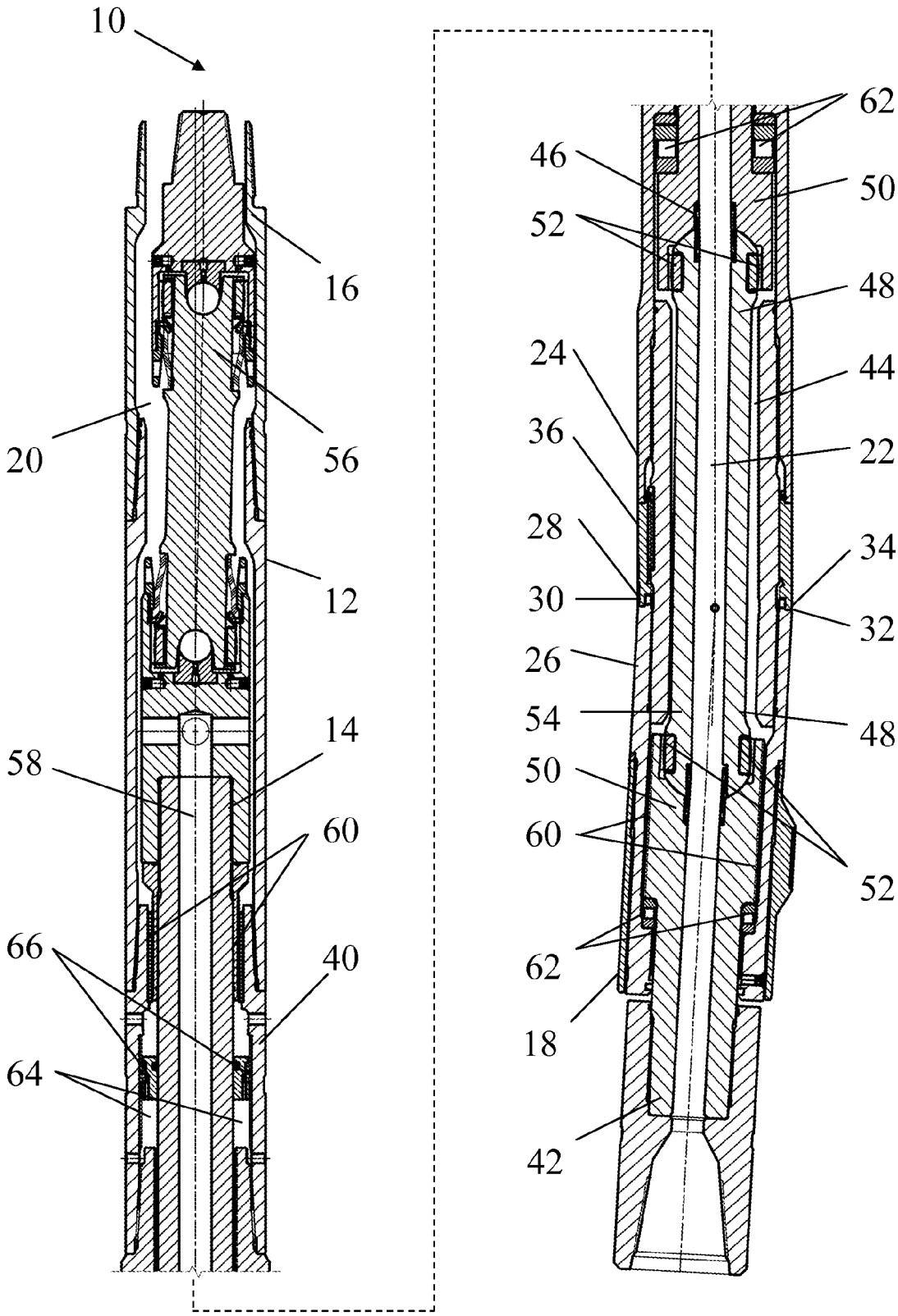
FIG. 1 is a side elevation view, in section, of a drive connection in a first angular orientation.

A drive connection generally identified by reference numeral 10, will now be described with reference to FIG. 1 through 10C.

Figure 2:
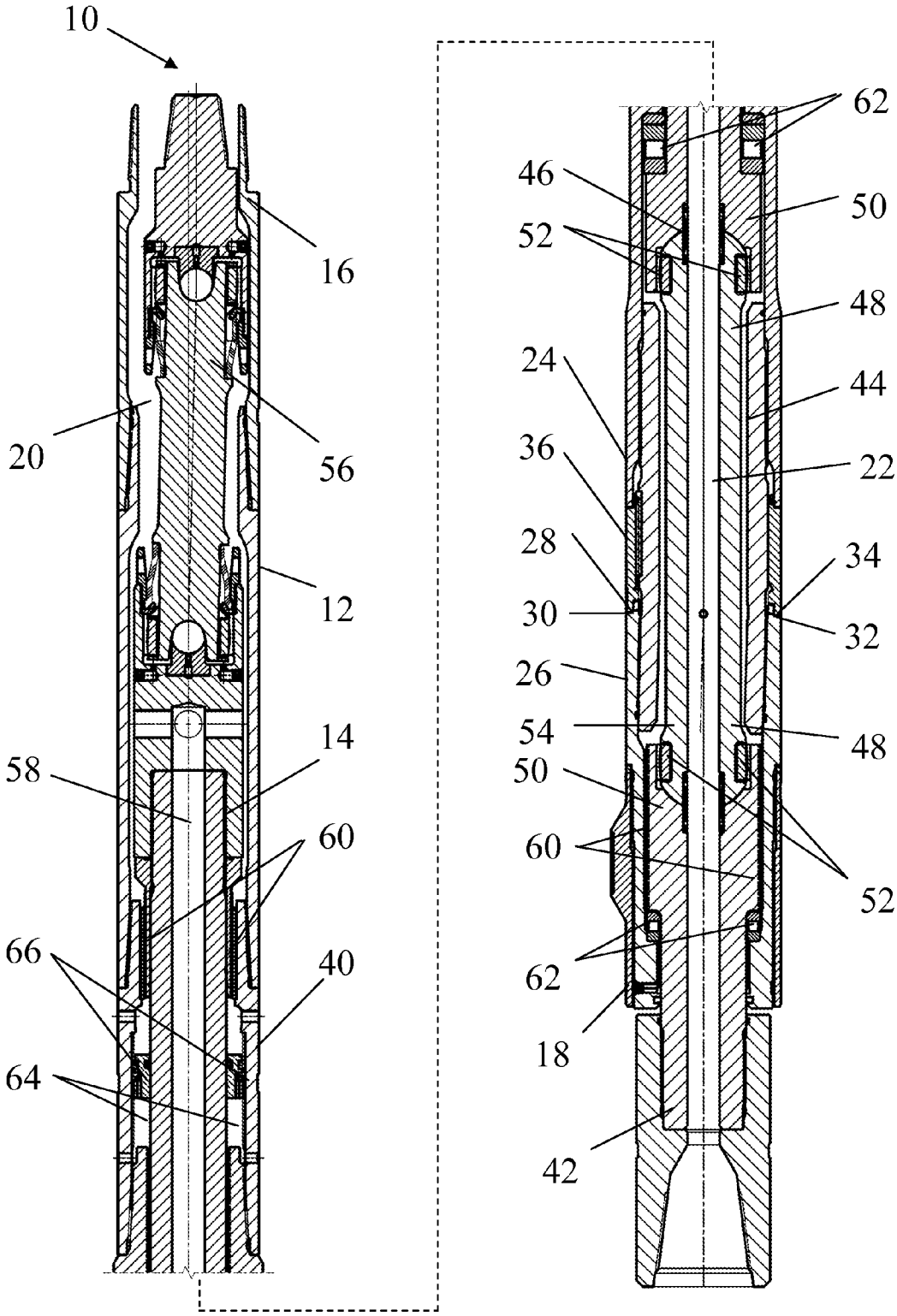
FIG. 2 is a side elevation view, in section, of the drive connection of FIG. 1 in a second angular orientation
Figure 3:
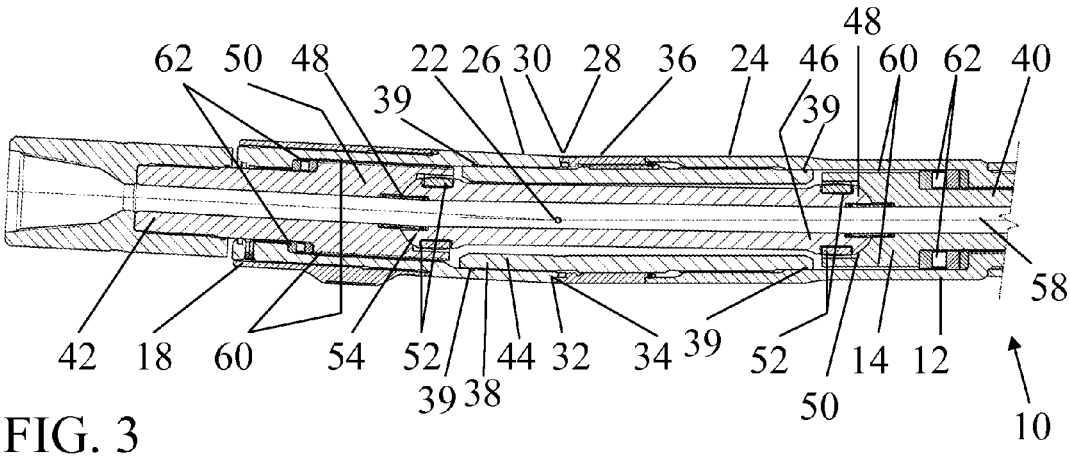
FIG. 3 is a detailed side elevation view, in section, of a bit end of the drive connection of FIG. 1.
Figure 4:
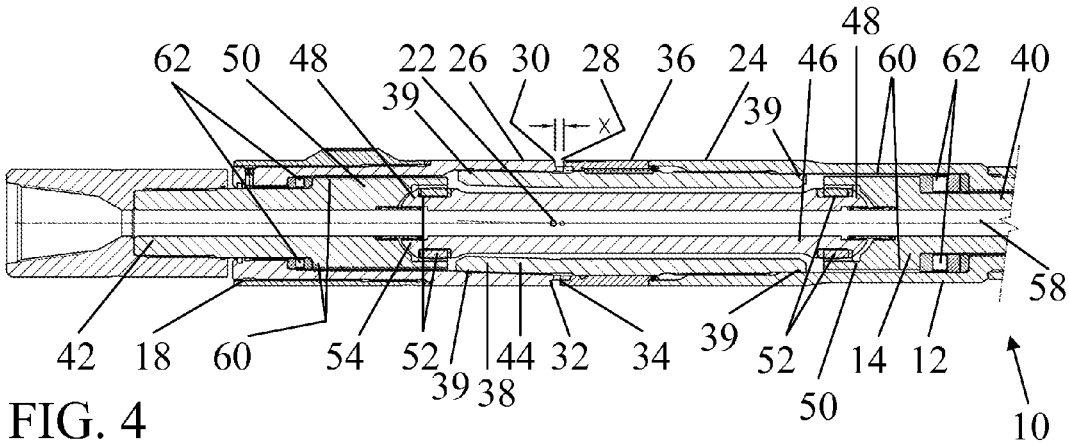
FIG. 4 is a detailed side elevation view, in section, of a bit end of the drive connection of FIG. 1, with first section of tubular outer housing and second section of tubular outer housing axially spaced with clutch engagement disengaged to allow relative rotation of adjustment of the angular offset.
Figure 5:
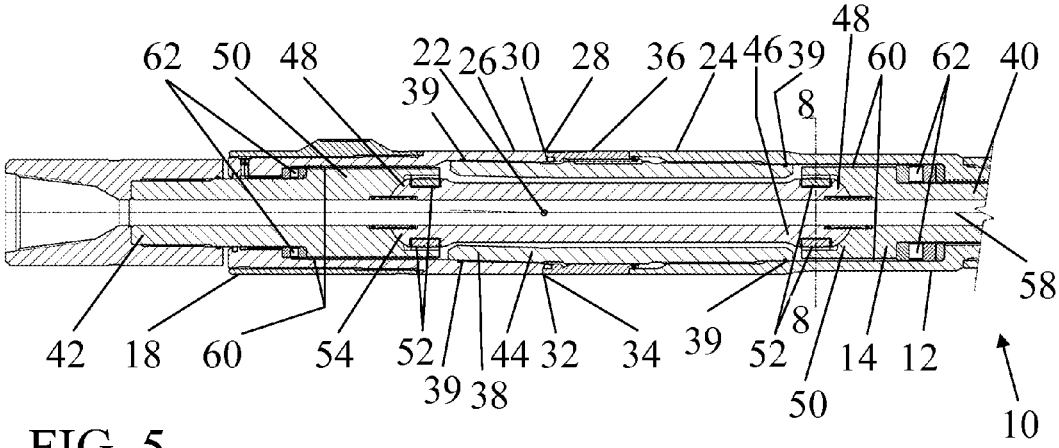
FIG. 5 is a detailed side elevation view, in section, of a bit end of the drive connection of FIG. 2.

Structure and Relationship of Parts:

Referring to FIGS. 1 and 2, drive connection 10 includes a tubular outer housing 12 and a tubular inner mandrel 14. Tubular outer housing 12 has a motor end 16 and a bit end 18. Tubular outer housing 12 defines an interior bore 20. An angular offset 22 or "bend" is provided toward bit end 18 of tubular outer housing 12. The term "angular offset" is a more accurate term for this embodiment. The illustrated embodiment is an "adjustable" angular offset. Referring to FIG. 4, the angular offset 22 is created by dividing the components that make up outer housing 12 into a first section 24 and a second section 26. First section 24 and second section 26 are machined with offset ends 28 and 30, respectively. When offset ends 28 and 30 are placed in abutting end to end relation, relative rotation of first section 24 and second section 26 changes angular offset 22. Referring to FIG. 5, offset ends 28 and 30 can be rotated so that they cancel one another. In such an orientation, outer housing 12 is relatively straight. Referring to FIG. 3, offset ends 28 and 30 can be rotated so that they create a cumulative offset which is centred along abutting offset ends 28 and 30, as indicated by reference numeral 22, where angular offset 22 positioned. Referring to FIG. 4, there is a clutch engagement represented by dog clutch teeth 32 between abutting ends 28 and 30. Dog clutch teeth 32 prevent first section 24 and second section 26 from rotating and lock them in a selected angular orientation. Adjustment to angular offset 22 is made by axially moving first section 24 and second section 26 apart until the clutch engagement provided by dog clutch teeth 32 disengages enabling relative rotation of first section 24 and second section 26. A sleeve 34 is secured to first section 24 by engagement threads 36. Upon rotation of sleeve 34 in one rotational direction dog clutch teeth 32 on first section 24 are drawn away from dog clutch teeth 32 on second section 26. Upon rotation of sleeve 34 in an opposite rotational direction, dog clutch teeth 32 on first section 24 are moved into closer engagement with dog clutch teeth 32 on second section 26. A sealing element 38 extends across the dog clutch teeth 32 and the rotating sleeve 34 and provides a seal between a lubrication chamber and the adjustable angular offset 22. The sealing element 38 includes O-rings 39 and accommodates movement of the adjustable angular offset 22.

Figure 8:
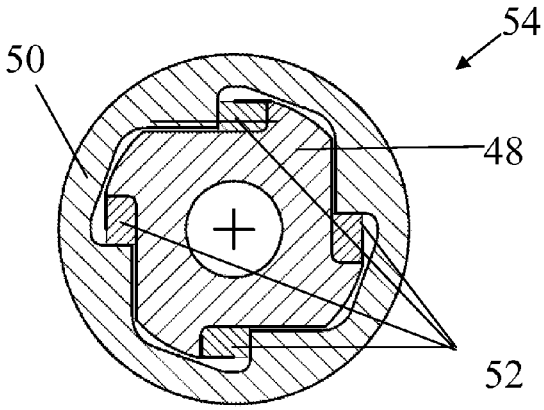
FIG. 8 is a cross section view, taken along section lines 8-8 of FIG. 5, showing radial drive members.
Figure 9:
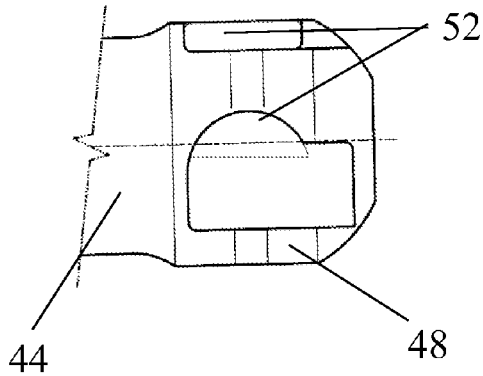
FIG. 9 is a detailed side elevation view, in section, of a ball and socket articulating engagement of the intermediate section of the drive connection of FIG. 1.
Figure 10A:
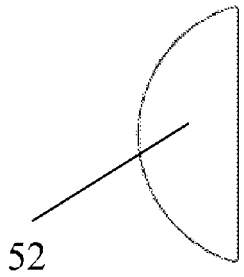
FIG. 10A is a side elevation view of one of the radial drive members.
Figure 10B:
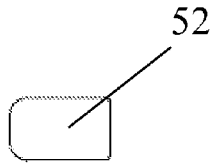
FIG. 10B is a end elevation view of one of the radial drive members.
Figure 10C:
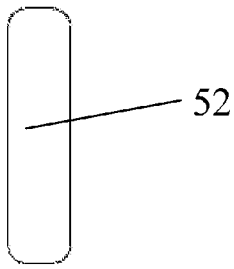
FIG. 10C is a bottom plan view of one of the radial drive members.

Referring to FIGS. 1 and 2, tubular inner mandrel 14 is positioned within interior bore 20 of outer housing 12. Tubular inner mandrel 14 consists of a motor end section 40, a bit end section 42 and an intermediate section 44 connecting motor end section 40 and bit end section 42. There is an upper articulating engagement, generally indicated by reference numeral 46, between intermediate section 44 and motor end section 40. Referring to FIG. 3 through 5, upper articulating engagement 46 includes a ball end 48 on intermediate section 44 and a receiving socket 50 on motor end section 40. Referring to FIG. 9, ball end 48 is illustrated. Referring to FIG. 8, radial drive members 52 are provided that rotatably couple intermediate section 44 and motor end section 40, so that intermediate section 44 rotates with motor end section 40. There is also a lower articulating engagement, generally indicated by reference numeral 54, between intermediate section 44 and bit end section 42. Lower articulating engagement 54 also includes a ball end 48 on intermediate section 44 and a receiving socket 50 on bit end section 42. Radial drive members 52 are also provided that rotatably couple intermediate section 44 and bit end section 42, so that intermediate section 44 rotates with bit end section 42. Referring to FIGS. 10A, 10B and 10C, views of one of radial drive members 52 are shown to indicate the structure of the drive members. In the result, all components of tubular inner mandrel 14 (motor end section 40, intermediate section 44 and bit end section 42) rotate together, with upper articulating engagement 46 and lower articulating engagement 54 accommodating rotation that is offset due to angular offset 22.

Figure 6:
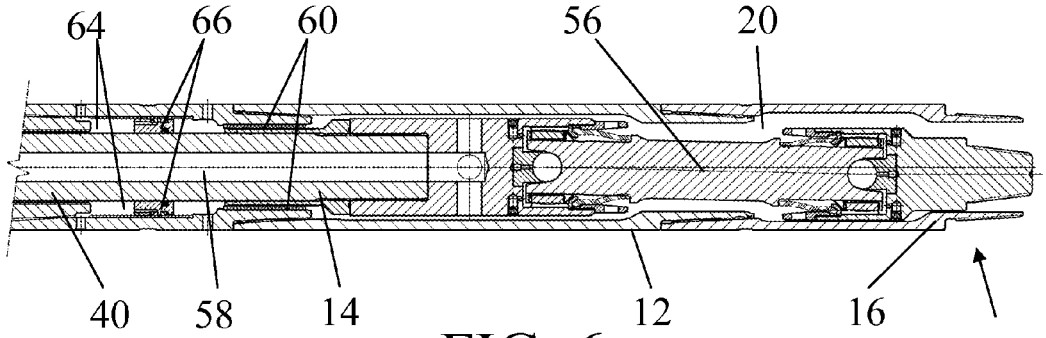
FIG. 6 is a detailed side elevation view, in section, of a motor end of the drive connection of FIG. 1, with internal drive shaft in a first orientation.
Figure 7:
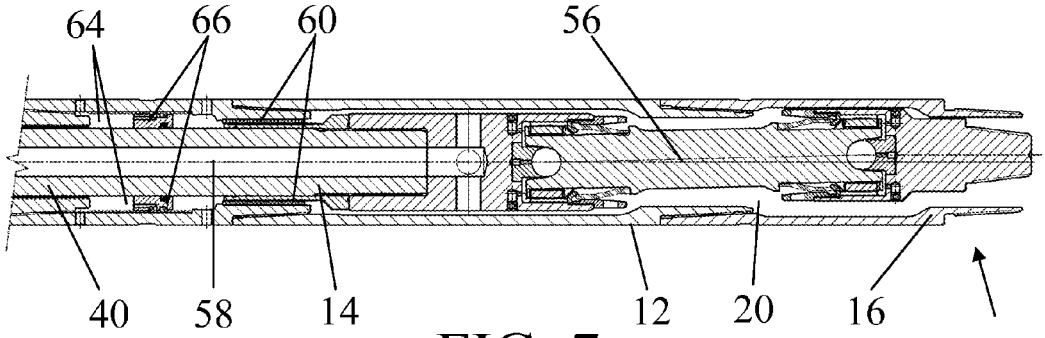
FIG. 7 is a detailed side elevation view, in section, of a motor end of the drive connection of FIG. 1, with internal drive shaft in an alternative orientation.

There are a number of ways of providing a rotational force to tubular inner mandrel 14. A turbine can provide a direct rotational force, but some form of gear reduction is generally required, as most turbines rotate so rapidly that excessive bit wear occurs. The most common form of rotational force is provided by a moineau style downhole drilling motor. These downhole drilling motors rotate in an eccentric fashion. Referring to FIGS. 6 and 7, a drive shaft 56 is positioned in interior bore 20 of tubular outer housing 12 at motor end 16. Drive shaft 56 is capable of converting offset rotation of a downhole drilling motor (not shown) into concentric rotation for input into motor end section 40 of tubular inner mandrel 12.

There must be a continuous flow of drilling fluids in order to carry cuttings to surface. In this embodiment inner mandrel 14 is tubular and the tubular structure defines a central drilling fluid flow channel 58 allowing passage of drilling fluids from motor end 16 of tubular outer housing 12 through motor end section 40, intermediate section 44 and bit end section 42 of tubular inner mandrel 14 to the drill bit (not shown).

In order to facilitate rotation of inner mandrel 14, radial bearings 60 are provided. In order to address axial loading thrust bearings 62 are provided. Radial bearings 60 and thrust bearings 62 support inner mandrel 14 for rotation within interior bore 20 of outer housing 12. It is preferred that angular offset 22 be positioned across intermediate section 44 of inner mandrel 14 between radial bearings 60 and between thrust bearings 62. This positioning facilitates inner mandrel 14 accommodating angular offset 22, while ensuring that angular offset 22 does not interfere with the operation of radal bearings 60 or thrust bearings 62. A lubricant reservoir 64 is provided above angular offset 22 to supply radial bearings 60 and thrust bearings 62 with lubricant via a sealed lubrication chamber that traverses the adjustable angular offset. An annular floating piston 66 surrounds motor end section 40 of inner mandrel 14 and defines an upper end of lubricant reservoir 64. Pressure exerted by drilling fluids upon floating piston 66 serve to pressurize lubricant in lubricant reservoir 64.

Operation:

Referring to FIG. 1, in operation, drive connection 10 is connected as part of a drill string, with motor end 16 of outer housing 12 connected to a drilling motor (not shown) and that portion of inner mandrel 14 protruding from bit end 18 of out housing connected to a drill bit (not shown). Referring to FIG. 3 through 5, prior to lowering drive connection 10 into the wellbore, angular offset 22 is adjusted. This is accomplished by rotation of sleeve 34 in one rotational direction to draw dog clutch teeth 32 on first section 24 away from dog clutch teeth 32 on second section 26. Once dog clutch teeth 32 are disengaged, relative rotation of first section 24 and second section 26 allows a selection to be made. Sleeve 34 is then rotated the opposite rotational direction so that dog clutch teeth 32 on first section 24 are moved back into engagement with dog clutch teeth 32 on second section 26. Referring to FIGS. 6 and 7, when drilling motor operates, the rotational force received from the output end of the drilling motor is converted into concentric rotation by drive shaft 56. The input into motor end section 40 of inner mandrel 14 received via drive shaft 56 is a concentric rotation. Referring to FIG. 3 through 5, concentric rotation of inner mandrel 14 is adversely affected by angular offset 22. Upper articulating engagement 46 and lower articulating engagement 54 accommodate offset rotation caused by angular offset 22. Referring to FIG. 8, radial drive members 52 ensure that all components of tubular inner mandrel 14 (motor end section 40, intermediate section 44 and bit end section 42) rotate together. The positioning of radial bearings 60 and thrust bearings 62 above and below angular offset 22 is selected to avoid the functioning of these bearing being adversely affected by angular offset 22. The bearings are kept lubricated by lubricant reservoir 64, with floating piston 66 ensuring that lubricant within lubricant reservoir 64 is kept at substantially the same pressure as drilling fluids passing through central drilling fluid channel of inner mandrel 14

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A drive connection for a down hole drilling motor, comprising:

a tubular outer housing having a motor end and a bit end, the tubular outer housing defining an interior bore;

an adjustable angular offset being provided toward the bit end of the tubular outer housing;

an inner mandrel positioned within the interior bore of the outer housing, the inner mandrel being comprised of:

a motor end section;

a bit end section; and an intermediate section connecting the motor end section and the bit end section, the intermediate section having an upper articulating engagement that is coupled to rotate with the motor end section and a lower articulating engagement that is coupled to rotate with the bit end section, such that the motor end section, intermediate section and bit end section rotate together with the upper articulating engagement and the lower articulating engagement accommodating eccentric rotation caused by the angular offset;

at least one continuous drilling fluids passage extending from the motor end of the tubular outer housing to the bit end section of the inner mandrel; and bearings that rotatably support the inner mandrel within the tubular outer housing, the bearings being disposed in a sealed lubrication chamber that traverses the adjustable angular offset.

2. The drive connection of claim 1, wherein the inner mandrel is tubular, the tubular inner mandrel defining a central drilling fluid flow channel.

3. The drive connection of claim 1, wherein the upper articulating engagement and the lower articulating engagement each are comprised of a ball and socket.

4. The drive connection of claim 1, wherein the intermediate section is coupled to rotate with the motor end section and the bit end section by radial drive members.

5. The drive connection of claim 1, wherein a drive shaft is positioned in the interior bore of the housing at the motor end, the drive shaft converting eccentric rotation of a down hole drilling motor into concentric rotation for input into the motor end section of the inner mandrel.

6. The drive connection of claim 1, wherein the angular offset is positioned between radial bearings.

7. The drive connection of claim 1, wherein the angular offset is positioned between thrust bearings.

8. The drive connection of claim 1, wherein the angular offset is positioned across the intermediate section of the inner mandrel.

9. The drive connection of claim 1, wherein the sealed lubrication chamber comprises a lubricant reservoir.

10. The drive connection of claim 9, wherein the lubricant reservoir is positioned above the angular offset.

11. The drive connection of claim 1, further comprising a sealing element that provides a seal between the lubrication chamber and the adjustable angular offset, the sealing element accommodating movement of the adjustable angular offset.

12. A drive connection for a down hole drilling motor, comprising:

a tubular outer housing having a motor end and a bit end, the tubular outer housing defining an interior bore;

an adjustable angular offset being provided toward the bit end of the tubular outer housing, the outer housing being comprised of a first section and a second section in abutting end to end relation, relative rotation of the first section and the second section changing the angular offset, wherein a clutch engagement between abutting ends maintains the first section and the second section in an orientation with a selected angular orientation, adjustment to the angular offset being made by axially moving the first section and second section apart until the clutch engagement disengages, enabling relative rotation of the first section and the second section;

a tubular inner mandrel positioned within the interior bore of the outer housing, the tubular inner mandrel being comprised of:

a motor end section;

a bit end section; and an intermediate section connecting the motor end section and the bit end section, the intermediate section having a ball and socket providing an upper articulating engagement with radial drive members that couple the intermediate section to rotate with the motor end section and a ball and socket providing a lower articulating engagement with radial drive members that couple the intermediate section to rotate with the bit end section, such that the motor end section, intermediate section and bit end section rotate together with the upper articulating engagement and the lower articulating engagement accommodating eccentric rotation caused by the angular offset;

a drive shaft positioned in the interior bore of the housing at the motor end, the drive shaft being capable of converting eccentric rotation of a down hole drilling motor into concentric rotation for input into the motor end section of the tubular inner mandrel;

the tubular inner mandrel defining a central drilling fluid flow channel allowing passage of drilling fluids from the motor end of the tubular outer housing through the motor end section, the intermediate section and the bit end section of the tubular inner mandrel; and radial bearings and thrust bearings supporting the mandrel for rotation within the interior bore of the outer housing, the radial bearings and thrust bearings being positioned within a sealed lubrication chamber, the angular offset being positioned across the intermediate section of the inner mandrel between radial bearings and between thrust bearings.

13. The drive connection of claim 12, wherein a lubricant reservoir is provided above the angular offset to supply the radial bearings and the thrust bearings with lubricant.

14. The drive connection of claim 13, wherein an annular floating piston surrounds the motor end section of the tubular inner mandrel and defines an upper end of the lubricant reservoir, pressure exerted by drilling fluids upon the floating piston serving to pressurize lubricant in the lubricant reservoir.

15. The drive connection of claim 12, further comprising a sealing element that provides a seal between the lubrication chamber and the adjustable angular offset, the sealing element accommodating movement of the adjustable angular offset.

* * * * *